US006050064A

United States Patent [19]

Yuyama et al.

[11] Patent Number: 6,050,064

[45] Date of Patent: Apr. 18, 2000

[54] TABLET PACKING APPARATUS

[75] Inventors: Hiroyuki Yuyama; Hiroyasu Hamada, both of Toyonaka, Japan

[73] Assignee: Yuyama Mfg. Co., Ltd., Toyonaka, Japan

[21] Appl. No.: 09/295,353

[22] Filed: Apr. 21, 1999

[30] Foreign Application Priority Data

Oct. 23, 1997 [JP] Japan ..... 9-290800

[51] Int. Cl.[7] ..... B65B 63/00

[52] U.S. Cl. ..... 53/514; 53/513; 53/493; 53/168; 53/154; 53/237

[58] Field of Search ..... 83/932; 53/435, 53/513, 514, 154, 155, 168, 237, 238, 445, 474, 493

[56] References Cited

U.S. PATENT DOCUMENTS 4,173,825 11/1979 Leopoldi et al. .
4,199,863 4/1980 Deckert .
5,038,475 8/1991 Wolff .
5,097,652 3/1992 Inamura et al. .
5,481,855 1/1996 Yuyama .
5,502,944 4/1996 Kraft et al. .
5,671,592 9/1997 Yuyama et al. .
5,678,393 10/1997 Yuyama et al. .

FOREIGN PATENT DOCUMENTS 6-7715 3/1994 Japan .

*Primary Examiner*—Daniel B. Moon
*Attorney, Agent, or Firm*—Wenderoth, Lind & Ponack, L.L.P.

[57] ABSTRACT

A tablet packing apparatus is provided which can split a tablet into halves and wrap each of the half tablets automatically. Tablet supply section 1 supplies tablets housed therein kind by kind. Tablet cutting section 2 cuts a tablet supplied from the tablet supply section 1 into two parts. Tablet accumulating section 3 temporarily accumulates each tablet cut at the tablet cutting section. Tablet packing section 4 packs tablets stored in the tablet accumulating section 3.

11 Claims, 16 Drawing Sheets

TABLET PACKING APPARATUS

BACKGROUND OF THE INVENTION

The present invention relates to a tablet packing apparatus and, more particularly, to a tablet packing apparatus having a function to cut a tablet into halves for delivering it to a child patient or for the like purpose.

In case that the patient is a child, if one tablet is prescribed for one dose, the dose is too much for the child. Therefore, it has been customary practice to cut the tablet into halves to prescribe one half of the tablet. In such a case, although it is common to manually divide the tablet into two parts, there has been proposed an arrangement such that one tablet is divided into halves by a tablet splitter (as disclosed in Japanese Utility Model Publication No. 6-7715, for example).

With manual cutting, however, there is disadvantages that operating efficiency is very poor, and that it is difficult to split the tablet accurately into halves.

Even when the tablet splitter is used, a tablet having no split line formed on the surface thereof can hardly be split accurately into halves. Furthermore, it is necessary that tablet splitting and subsequent packing must be separately carried out. This involves troublesome work, resulting in poor operating efficiency.

SUMMARY OF THE INVENTION

Therefore, it is an object of the present invention to provide a tablet packing apparatus which can split a tablet into halves and pack each of the halves automatically.

In order to accomplish the above object, the tablet packing apparatus in accordance with the present invention comprises:

- a tablet supply section for supplying tablets stored kind by kind;
- a tablet cutting section for cutting each tablet supplied from the tablet supply section into two parts;
- a tablet accumulating section for accumulating tablets cut by the tablet cutting section; and
- a tablet packing section for packing tablets stored in the tablet accumulating section.

In the tablet packing apparatus of above described construction, tablets supplied sequentially from the tablet supply section are each cut into two parts at the tablet cutting section, being then accumulated in the tablet accumulating section. Half tablets supplied from the tablet accumulating section are sequentially packed at the tablet packing section. Thus, it is possible to automatically divide and pack a tablet. Therefore, manual work or the like operation is unnecessary, which provides for efficient packing operation.

Preferably, the tablet supply section includes a passage changeover means for changing over between a passage for supplying tablets to the tablet cutting section and a passage for supplying tablets directly to the tablet packing section.

By virtue of this arrangement, changeover control of the passage changeover means causes a tablet to be supplied directly to the tablet packing section in the case where the tablet is to be packed as it is, and in the case where the tablet is to be packed in the form of two separate halves, the tablet is supplied through the tablet cutting section and the tablet accumulating section to the tablet packing section. This makes it possible to automatically select tablets in the form of halves.

Preferably, the tablet cutting section comprises:

- a transport portion for transporting tablets supplied from the tablet supply section; and

- a tablet positioning portion for positioning tablets transported by the transport portion at predetermined positions.

According to this arrangement, tablets supplied to the tablet cutting section are transported by the transport portion and positioned by the positioning portion at desired cutting positions. Thus, the tablet is cut at desired cutting position, providing for freedom of layout.

Preferably, the tablet positioning portion has inclined surfaces adapted to abut the tablet from opposite sides in rectangular relation to the direction of tablet transport in such a way as to press the tablet downward.

According to this arrangement, the inclined surfaces come equally close to the tablet from opposite sides. Therefore, even when the tablet is fed off center, the tablet goes into abutment with one of the inclined surfaces so that it can be accurately moved to the desired cutting position. Furthermore, since the tablet is pressed downward by the inclined surfaces, the tablet will not go out of cutting position during cutting operation. This makes it possible to accurately position the tablet at cutting position and to accurately divide the tablet into halves.

Preferably, the tablet cutting section includes:

- a cutter for notching a tablet; and
- a divider roller for dividing the tablet into two halves along a notch formed by the cutter.

According to this arrangement, the tablet is formed with a notch by the cutter to be made easy to divide, and is then pressed down and divided by the divider roller. This makes it possible to accurately divide the tablet into halves without difficulty.

Preferably, the tablet accumulating section includes a half-tablet collecting assembly for stocking half tablets obtained at the tablet cutting section and supplying the half tablets, one by one, to the tablet packing section.

According to this arrangement, tablets cut at the tablet cutting section are sequentially accumulated at the half-tablet collecting assembly and, thereafter, are supplied to the tablet packing section as required. This enables efficient tablet cutting operation and efficient packing operation.

Further, the tablet accumulating section preferably includes a half-tablet storing assembly for temporarily storing surplus half tablets remaining the half-tablet collecting assembly.

According to this arrangement, any half-tablet surplus which may occur over the number of packs required can be utilized for next-time packing purposes. Thus, even where the number of packs is an odd number, any surplus half-tablet may be utilized for next time and subsequent packing purposes, and this makes it possible to carry out wasteless packing operation.

Preferably, the tablet packing apparatus includes:

- memory means for storing cutting conditions corresponding to each respective kind of tablet; and
- control means operative to call the cutting conditions stored in the memory means according to the kind of tablet supplied and to drivingly control the tablet cutting section according to the cutting conditions.

According to this arrangement, when the kind of tablet supplied is read, corresponding cutting conditions are called from the memory means to drivingly control the cutter. Thus, the cutter is driven at proper rotational speed, proper rate of movement, and over proper distance of movement, and the tablet is formed thereon with a notch intended for ease of cutting into halves. Thus, the tablet can be accurately divided into two halves without difficulty.

Preferably, the tablet packing apparatus includes control means which causes the half-tablet storing assembly to supply appropriate half-tablets according to the difference in the number of packs at the tablet packing section.

According to this arrangement, if there occurs a half-tablet surplus, the half tablet may be stored in the half-tablet storing assembly for use in next-time and subsequent packing purposes.

In case that the number of packs of half tablets is an odd number, if a half tablet of the corresponding kind is stored in the tablet storing assembly, the tablets to be supplied from the tablet supply section to the tablet cutting section should be reduced by one in number.

In case that the number of packs of half tablets is an even number, if a half tablet of the corresponding kind is stored in the tablet storing assembly, one of the halves resulting from cutting at the tablet cutting section should be caused to replace the corresponding half tablet held in storage at the tablet storing assembly, which is desirable in that a fresh half-tablet is constantly held in storage.

BRIEF DESCRIPTION OF THE DRAWINGS

Further objects and advantages of the present invention will be become clear from the following description taken in conjunction with the preferred embodiments thereof with reference to the accompanying drawings, in which.

DETAILED DESCRIPTION OF THE PREFERRED EMBODIMENTS

Figure 1:
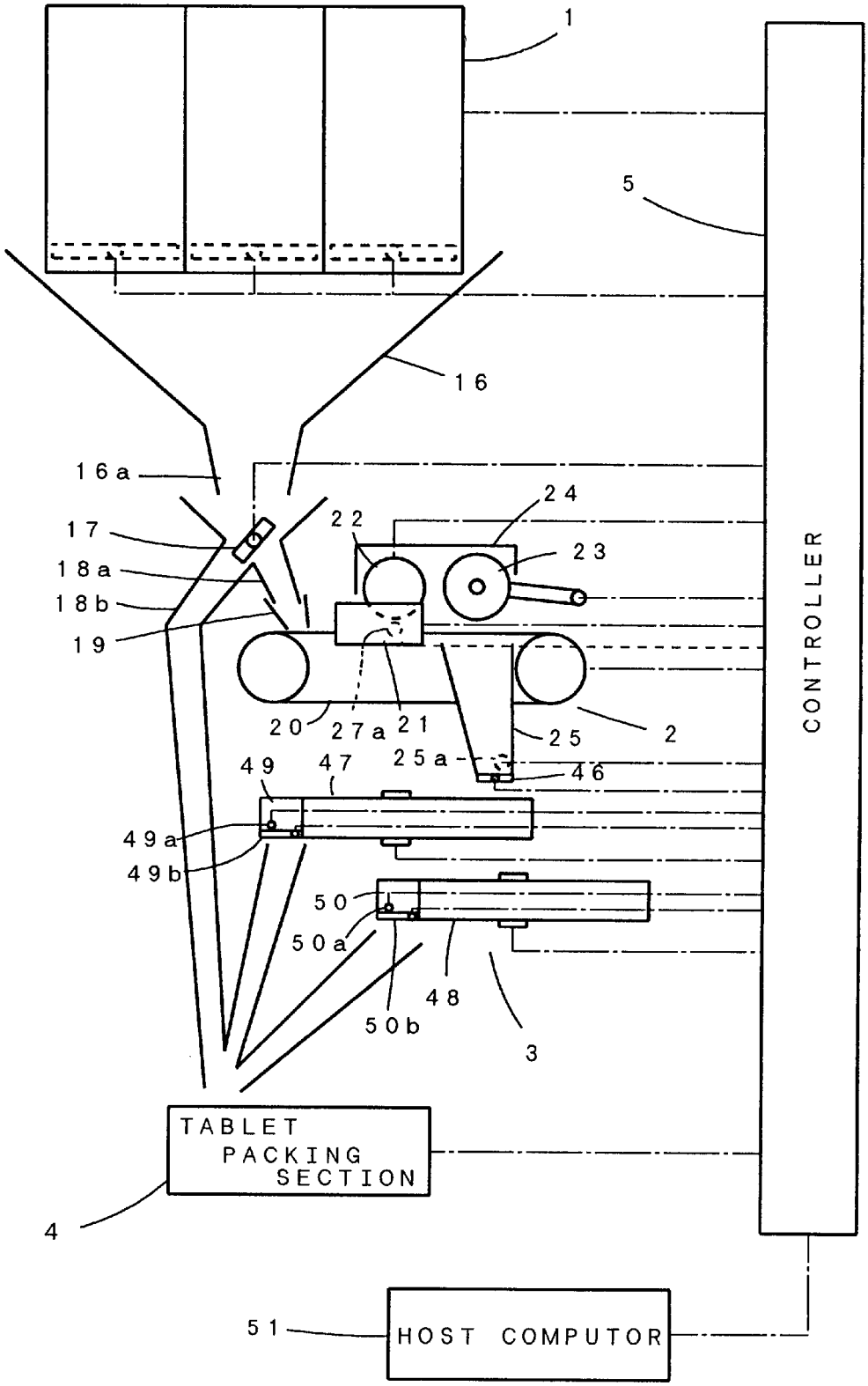
FIG. 1 is a schematic view of a tablet packing apparatus according to the present invention.

The tablet packing apparatus shown in FIG. 1 consists essentially of a tablet supply section 1, a tablet cutting section 2, a tablet accumulating section 3, a tablet packing section 4, and a controller 5.

Figure 2:
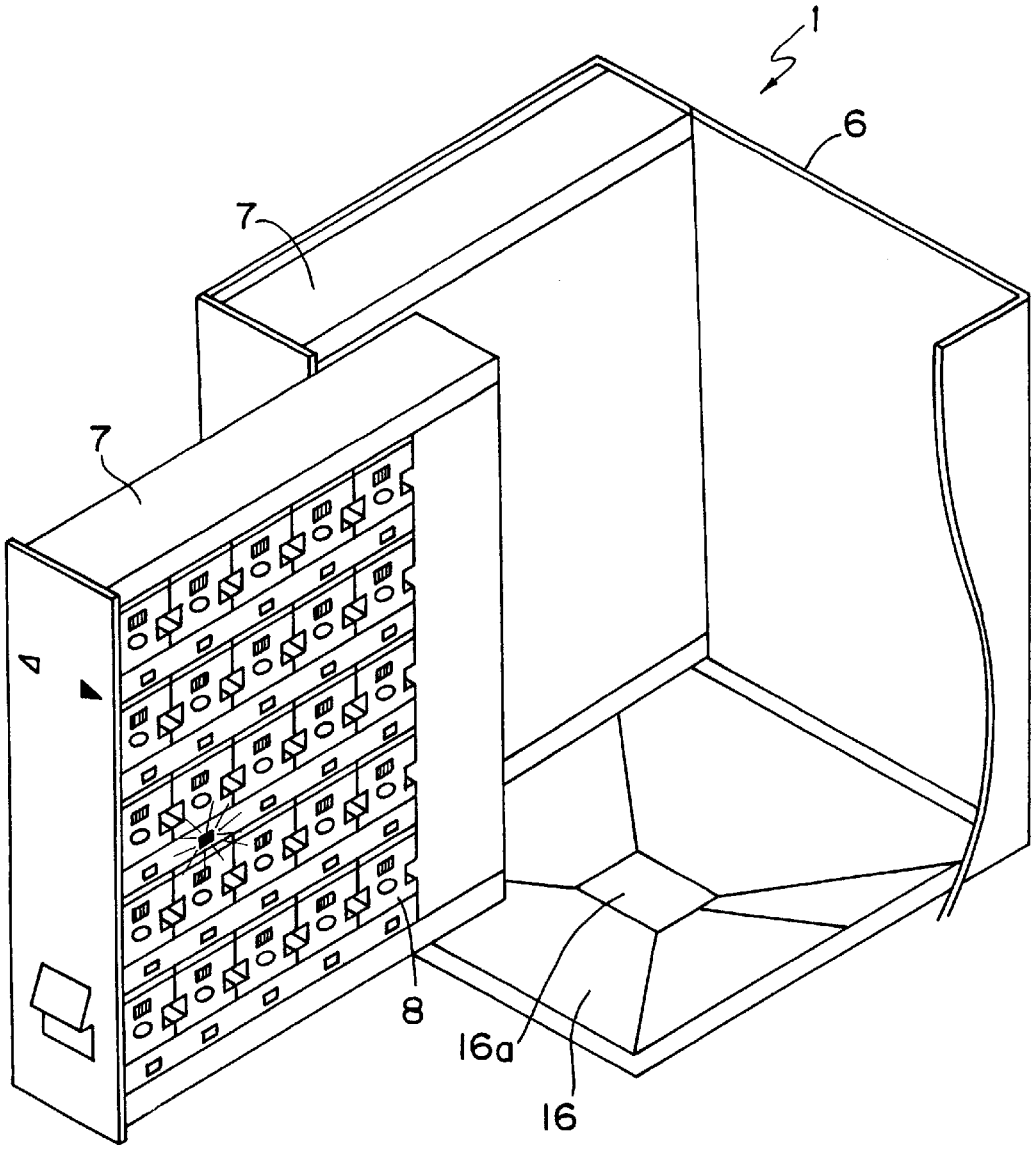
FIG. 2 is a partially cutaway view in perspective showing one example of a tablet supply section in FIG. 1.

As FIG. 2 shows, the tablet supply section 1 comprises a supply section body 6 of a box-like shape and plural drawer assemblies 7 arranged in parallel relation therein so as to be readily drawn.

Figure 3:
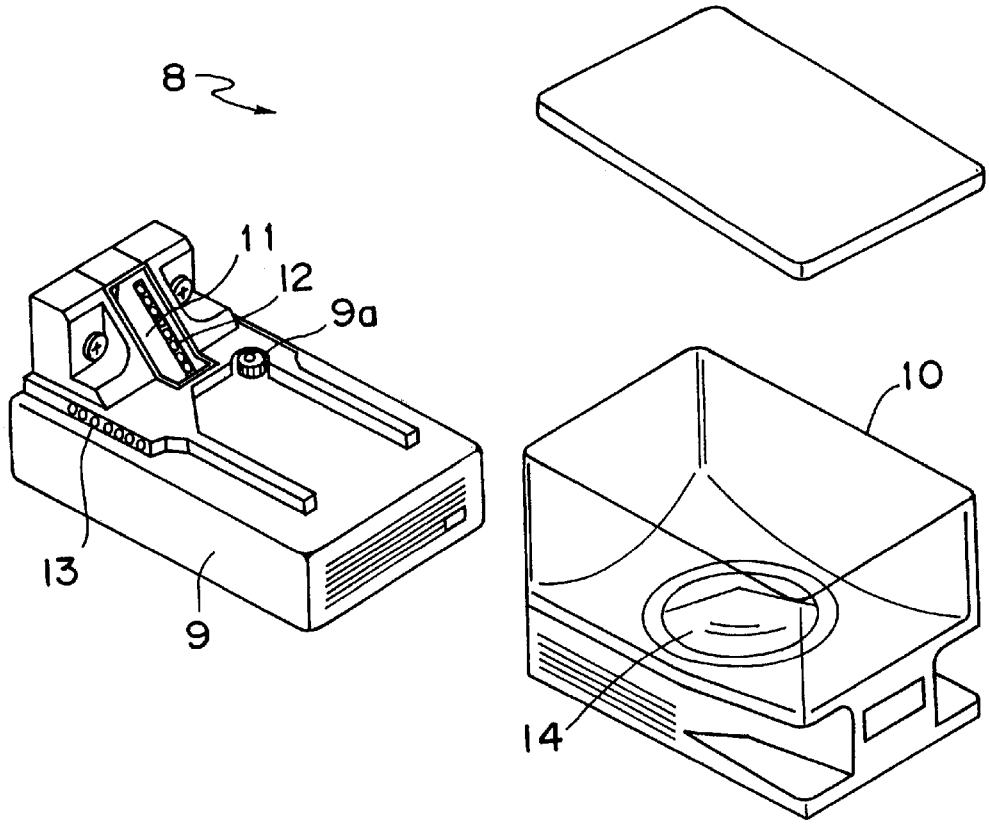
FIG. 3 is an exploded view in perspective of a tablet feeder in FIG. 2.
Figure 4:
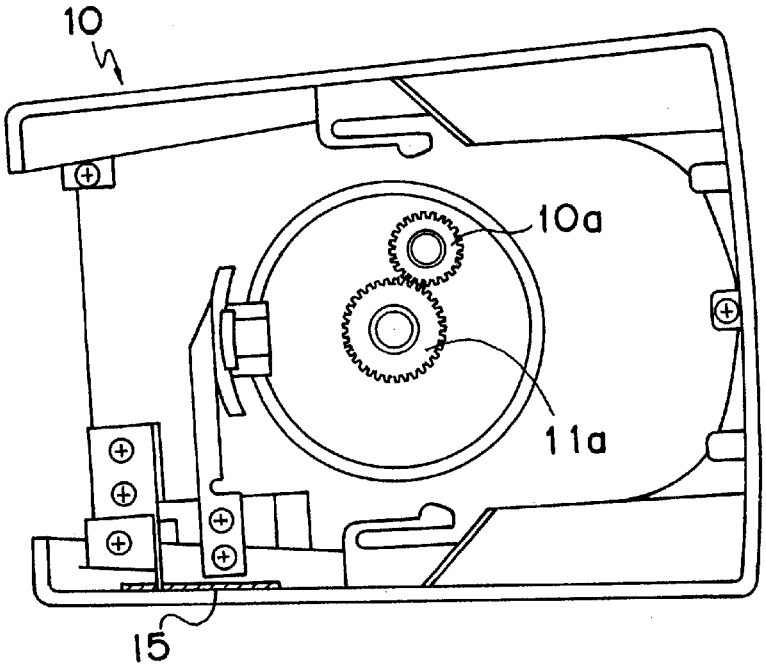
FIG. 4 is a bottom view of the tablet feeder in FIG. 3.

Each drawer assembly 7 comprises plural tablet feeders 8 arranged on both sides, with a tablet discharge path (not shown) each formed between the both sides tablet feeders 8. As FIGS. 3 and 4 show, each tablet feeder 8 includes a cartridge container 10 which is removably fitted on a motor base 9.

The motor base 9 incorporates a motor not shown, the driving force of which is transmitted to a gear 9*a* exposed on the upper surface of the motor base. Adjacent to the gear 9*a* there is formed a discharge passage 11 for tablet discharge. On the inner surface of the discharge passage 11 there is provided a tablet sensor 12 for detecting a tablet passing through the passage. Further, on the motor base 9 at one side of rails for guiding the cartridge container 10 there is provided a tablet identifying sensor 13 for identifying the kind of tablet in the cartridge container 10 mounted on the motor base 9.

The cartridge container 10 is provided with gears 10*a*, 11*a* engaged with each other on the bottom surface. The gear 10*a* engages with the gear 9*a* of the motor base 9, while the gear 11*a* is fixed to a shaft of a tablet alignment plate 14 which is rotatably mounted on the inner bottom of the cartridge container 10. Whereby, when the motor of the motor base 9 is driven, the tablet alignment plate 14 is rotated through gears 9*a*, 10*a*, and 11*a* to cause tablets housed in the container 10 to be discharged one by one to the tablet discharge passage 11 on the motor base 9. Further, the cartridge container 10 has a marker portion 15 to be detected by the tablet identifying sensor 13 when the cartridge container is mounted on the motor base 9. The marker portion 15 indicates the designation of tablet, which is binary-coded by a mark and a space.

Beneath the drawer assembly 7, as FIG. 2 shows, there is formed a hopper 16 for receiving a tablet dropping through the tablet discharge path 9 of each tablet feeder 8. The hopper 16 is a substantially pyramid-shaped hopper which is inclined downward gradually toward a center hole 16*a*. Below the center hole 16*a* there is provided an intermediate shutter 17 as shown in FIG. 1. By changing the pivoting position of the intermediate shutter 17 it is possible to cause a tablet dropping through each tablet discharge path 9 to be supplied to either the tablet cutting section 2 or the tablet packing section 4 through the tablet passage 18*a*, 18*b*.

Figure 5:
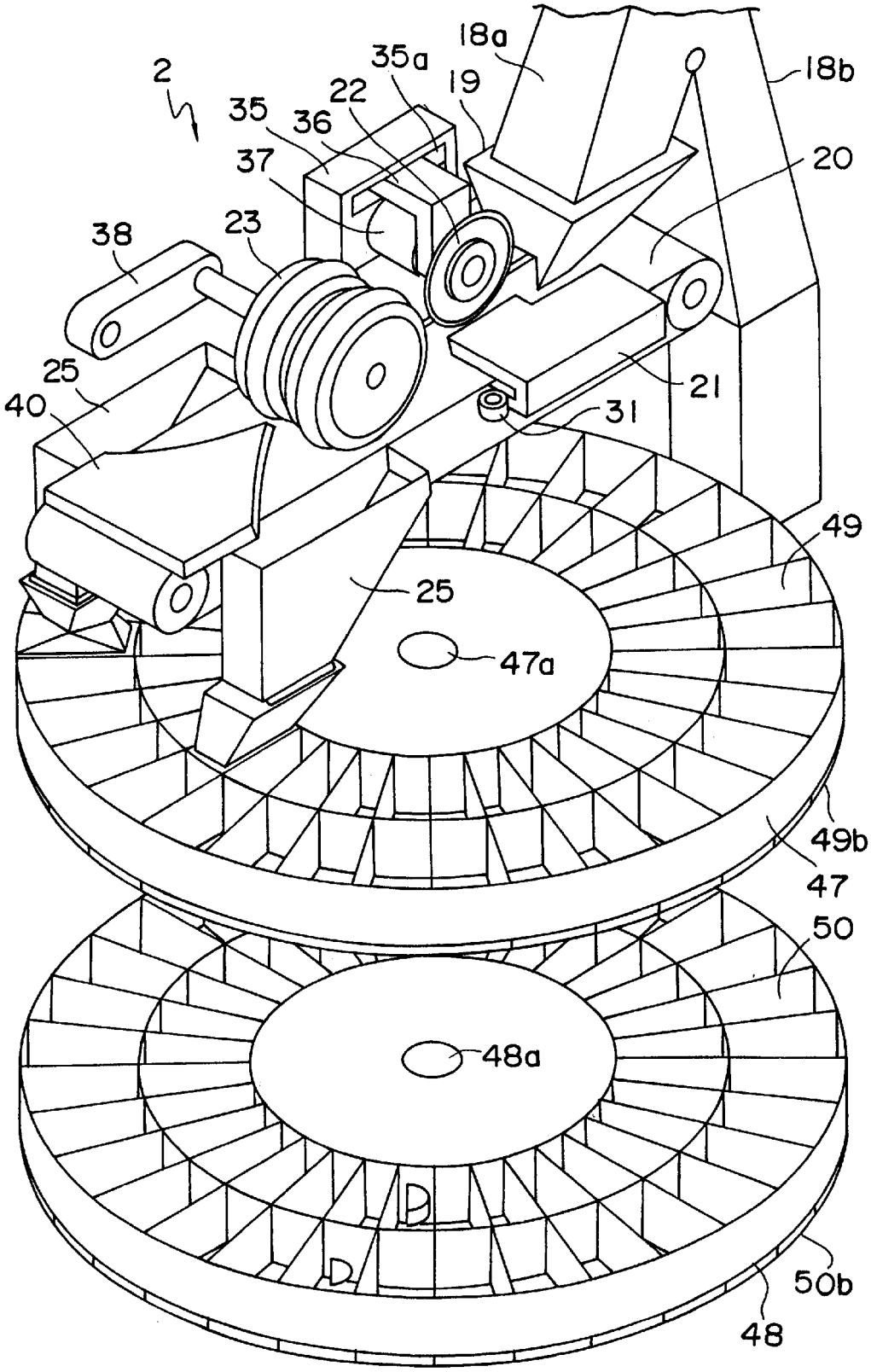
FIG. 5 is a perspective view of a tablet cutting section and a tablet reservoir section in FIG. 1.
Figure 6:
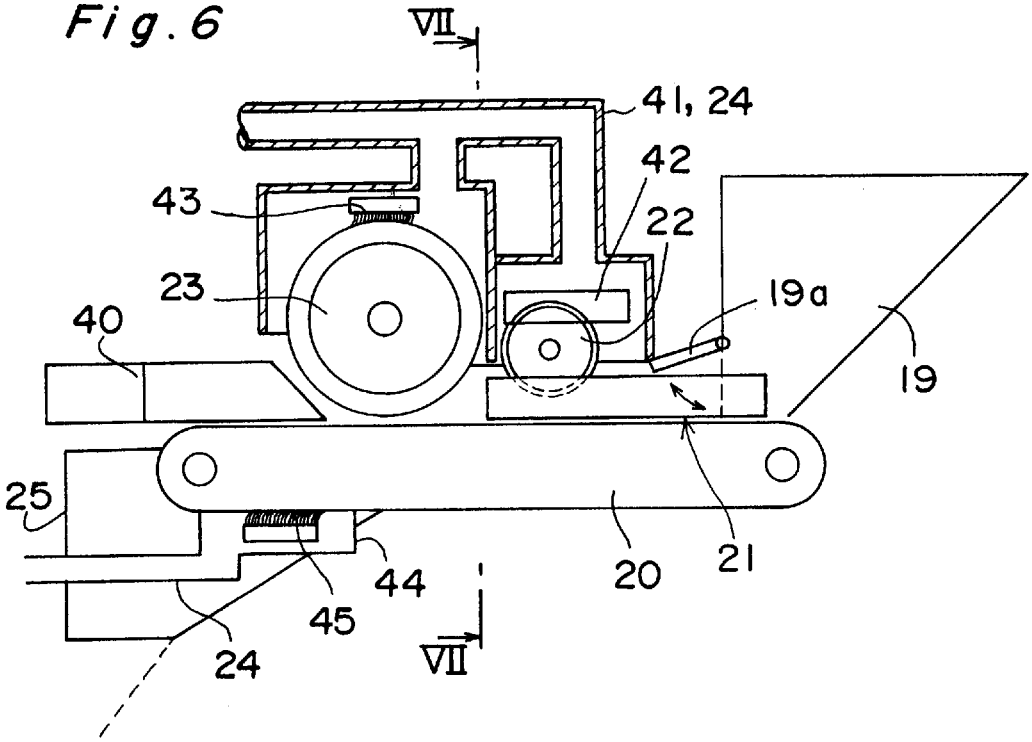
FIG. 6 is a front view of the tablet cutting section in FIG. 5.

As FIGS. 5 and 6 show, the tablet cutting section 2 includes a conveyer belt 20 for transporting tablets fed through the tablet passage 18*a* and a guide hopper 19. As shown in FIG. 6 a shutter 19*a* is pivotally provided at a lower end opening of the guide hopper 19. The shutter 19*a* is operative to stop once a tablet supplied onto the belt conveyer 20 through the guide hopper.

On a transport path of the belt conveyer 20 there are provided a tablet presser unit 21, a milling cutter 22, a divider roller 23, a cleaner unit 24, and a tablet retaining hopper 25.

Figure 7:
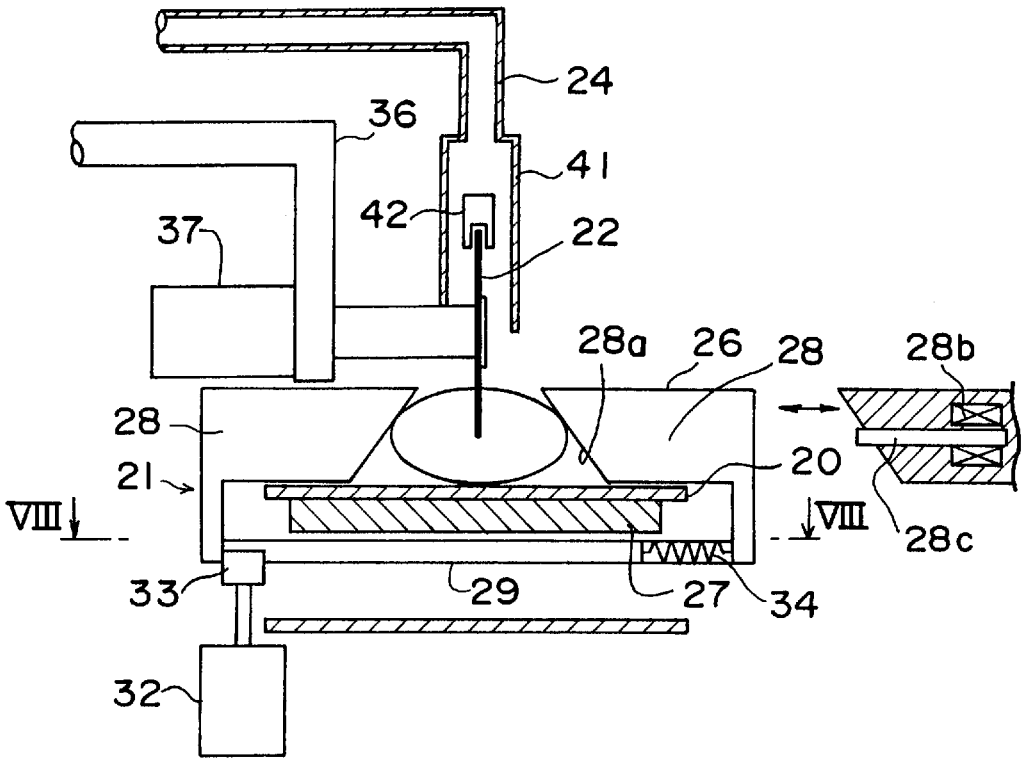
FIG. 7 is a cross sectional view taken along lines VII—VII of FIG. 6.

The tablet presser unit 21 consists of a pair of tablet presser portions 26 and a cutter table 27 as shown in FIG. 7.

Figure 8:
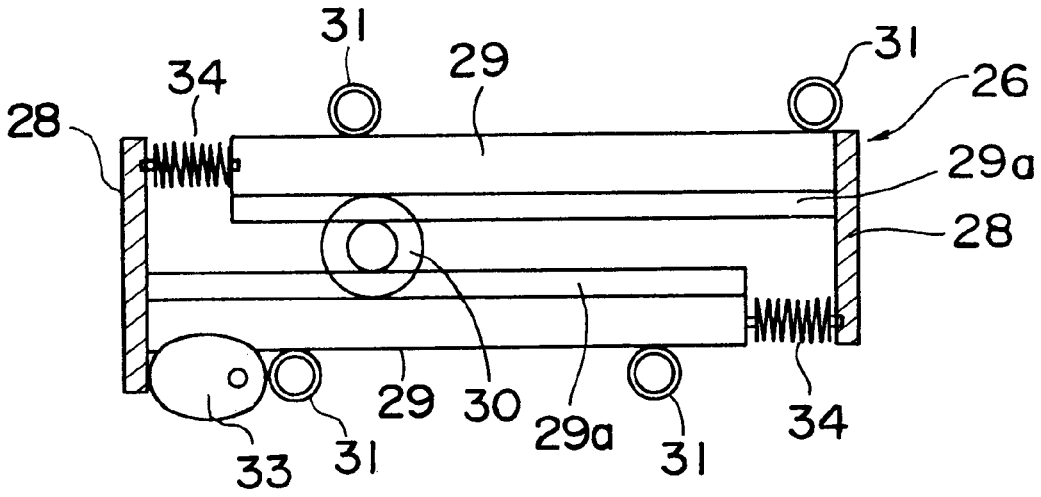
FIG. 8 is a cross sectional view taken along lines VIII—VIII of FIG. 7.

The tablet presser portions 26 comprise a pair of presser pieces 28 each having an inclined surface 28*a* at front end. Each presser piece 28 includes a driving piece 29 formed with a rack gear 29*a* at side face. The driving piece 29 extends from rear end of the presser piece 28 so as to form a generally L-shaped configuration when viewed in plan and a generally U-shaped configuration when viewed sideways in section. The inclined surface 28*a* of presser piece 28 is so formed as to be inclined upward gradually toward the front end. As FIG. 8 shows, a rotatably disposed gear 30 is in mesh engagement with the rack gears 29*a* of the driving pieces 29, and guide bearings 31 are rotatably held in abutment with the opposite side surface of each driving piece 29. A cam 33 which is to be driven to pivot by the driving force of a motor 32 is held in abutment with one of the presser pieces 28. The rear end of the one presser piece 28 and the front end of the driving piece 29 of the other tablet presser piece 29 are connected by a spring 34. The presser pieces 28 each incorporate a solenoid 28*b* so that a plunger 28*c* thereof retractably projects out of the inclined surfaces 28*a*. The plunger 28*c* acts to position each tablet transported on the belt conveyer 20 to a predetermined position in the direction of tablet transport.

The cutter table 27 is positioned on the underside of the upper run of the belt conveyer 20. The cutter table 27 is fixed to an extension from a tablet cutting section body not shown. For detecting a tablet transported by the belt conveyer 20 to a location, above the cutter table 27, there is provided a transported tablet position detecting sensor 27*a* (FIG. 1).

The milling cutter 22 is disposed at the distal end of a substantially L-shaped arm 36 extending from an upright support plate 35 (FIG. 6) disposed alongside the belt conveyer 20 so as to be driven to rotate by a motor 37. The support plate 35 is so disposed as to perform vertical reciprocating movement. The arm 36 is so disposed as to be reciprocably movable along the transport direction of the belt conveyer 20 in a rectangular hole 35*a* formed in the support plate 35.

Figure 9:
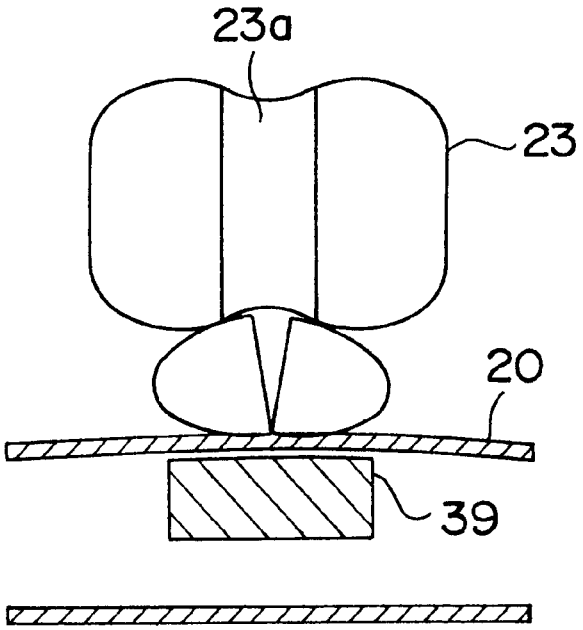
FIG. 9 is a front view of a divider roller shown in FIG. 6.
Figure 10:
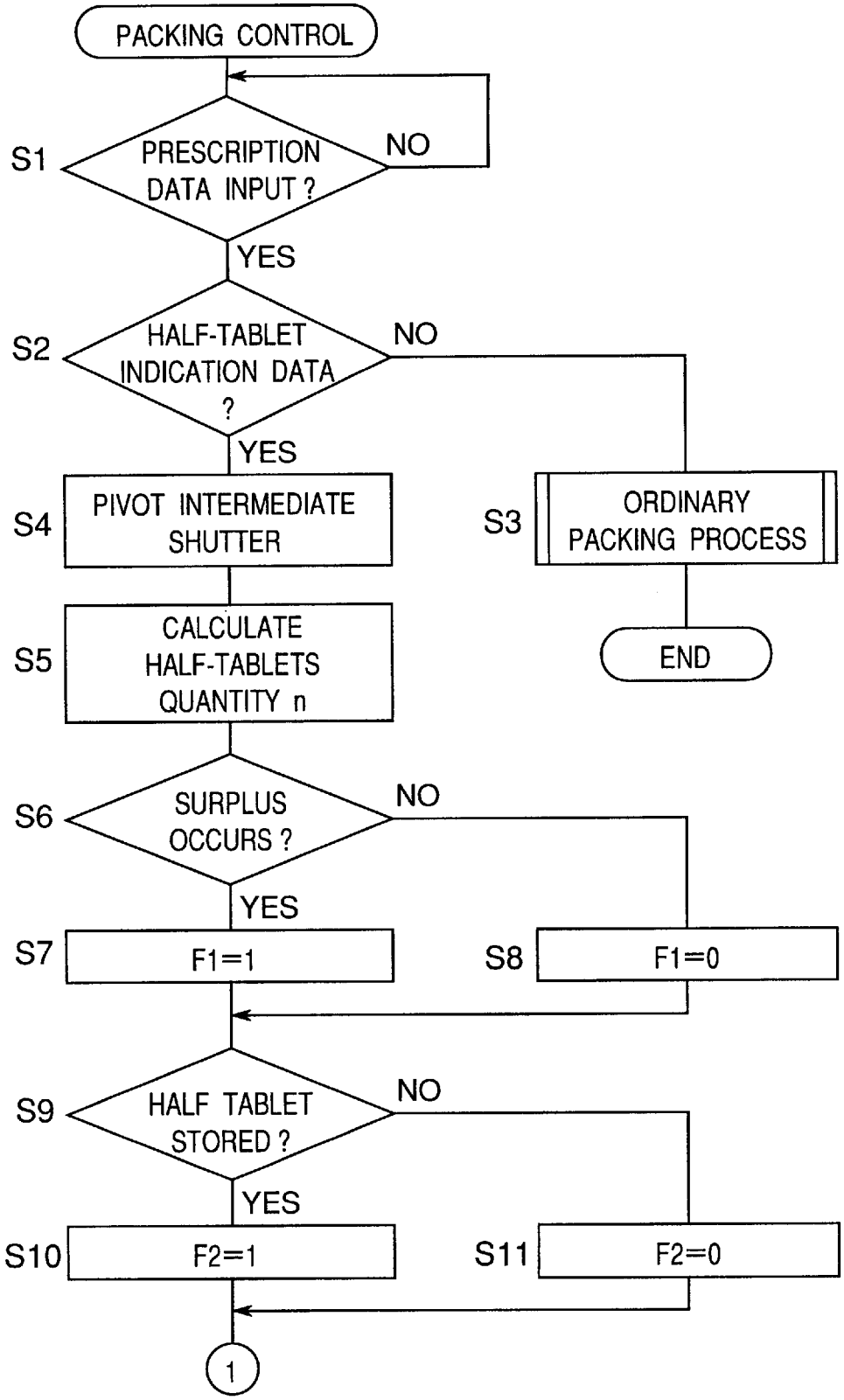
FIG. 10 is a flow chart showing the process of packing control.
Figure 11:
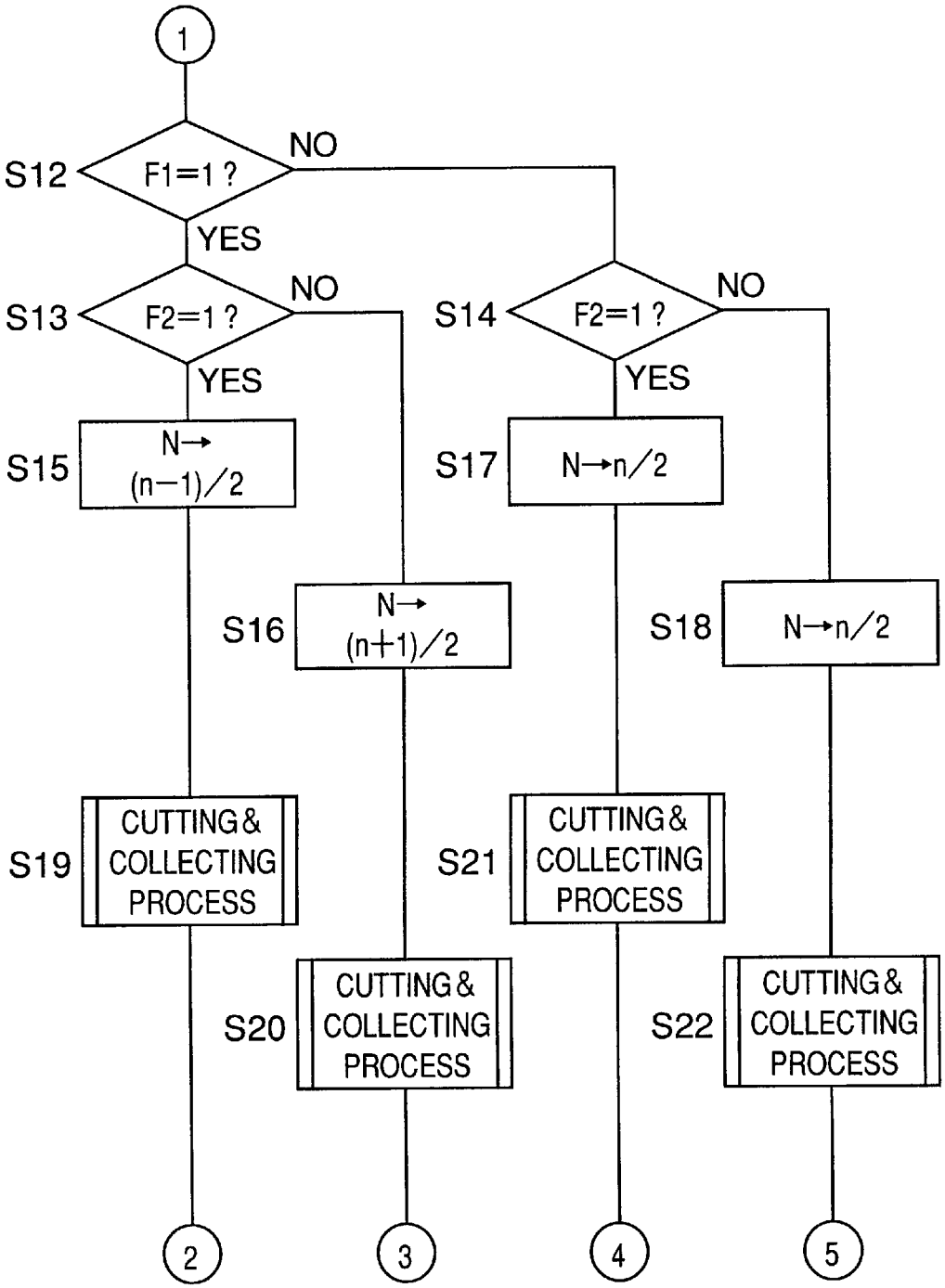
FIG. 11 is a flow chart showing the process of packing control continued from FIG. 10.
Figure 12:
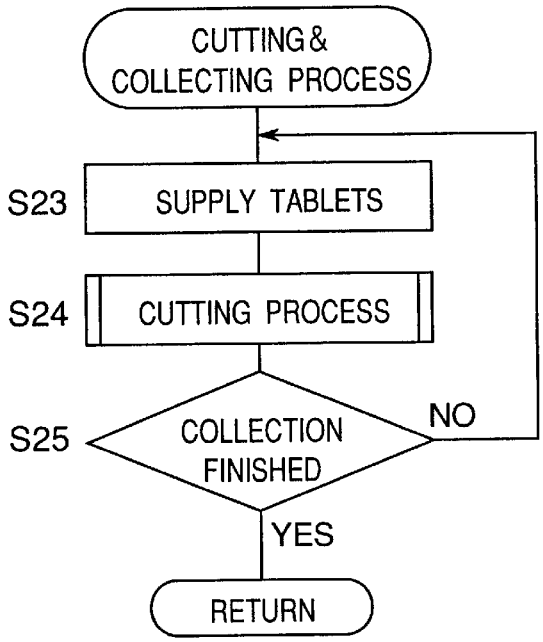
FIG. 12 is a flow chart showing the process of cutting and stocking in FIG. 11.

As FIG. 9 shows, the divider roller 23 is formed with an escape groove 23*a* centrally of the outer periphery thereof. The divider roller 23 is rotatably mounted at one end of a substantially L-shaped swivel arm 38 (FIG. 5). Along with the milling cutter 22, the divider roller 23 is reciprocably movable along the transport direction of belt conveyer 20. However, the divider roller 23 may be adapted to be reciprocably movable independently of the milling cutter 22. The divider roller 23 is also vertically movable through swivel movement of the swivel arm 38. On the underside of the upper run of belt conveyer 20 there is provided a split receiver plate 39 (FIG. 9) so that the tablet can be held between the divider roller 23 and the split receiver plate 39 when the split receiver plate 39 is moved downward. The upper surface of the split receiver plate 39 comprises a cylindrical surface with a curvature bulging upward to facilitate tablet cutting when the tablet is held between the split receiver plate 39 and the divider roller 23. Downstream of the divider roller 23 there is disposed a split guide plate 40 for guiding a split tablet to the tablet retaining hopper 25.

The cleaner unit 24 includes a hood 41 for covering the milling cutter 22 and the divider roller 23 from above as shown in FIGS. 6 and 7. On the milling cutter 22 side there is provided a high-voltage ion generator 42 for floating powder material adhering to the surface of the milling cutter 22 to facilitate sucking operation. On the divider roller 23 side there is provided a brush 43 for scraping off the powder material adhering to the surface of the divider roller 23 to facilitate sucking operation. Also, beneath the belt conveyer 20 there is provided a hood 44 in such a way as to partially cover the underside of the lower run of the belt conveyer. In the interior of the hood 44 there is provided a brush 45 for scraping off the powder material adhering to the belt conveyer 20 to facilitate sucking operation. It is to be noted, however, that the cleaner unit 24 is not limited to above mentioned construction, but any known construction intended for similar purposes (for example, high frequency vibration of a milling cutter) may be employed.

The tablet retaining hopper 25 is intended for temporarily retaining tablets split by the divider roller 23, and is disposed on both sides of the belt conveyer 20. At the lower end opening of the tablet retaining hopper 25, as shown in FIG. 1, there are provided a retained half-tablet detecting sensor 25*a* and a shutter 46.

As FIG. 5 shows, the tablet accumulating section 3 consists of a half-tablet collecting assembly 47 and a half-tablet storing assembly 48.

The half-tablet collecting assembly 47 is disc-shaped, and is partitioned at circumferentially specified intervals on both inner periphery side and outer periphery side to define a plurality of tablet collecting chambers 49. At a lower end opening of each tablet collecting chamber 49 there are provided a collected half-tablet detecting sensor 49*a* and a shutter 49*b*. The half-tablet collecting assembly 47 is adapted to rotate at a specified pitch about a rotary shaft 47*a* in a circumferential direction.

Whilst, the half-tablet storing assembly 48 has a configuration similar to that of the half-tablet collecting assembly 47 and has a plurality of tablet storing chambers 50 having, at a lower end opening of each storing chamber, a stored half-tablet detecting sensor 50*a* and a shutter 50*b*, the half-tablet storing assembly being rotatable at a specified pitch in circumferential direction.

The tablet packing section 4 is operative to pack tablets or half tablets supplied from the tablet supply section 1 or tablet accumulating section 3, one by one.

The controller 5, as FIG. 1 shows, receives signals from various sensors, such as the retained half-tablet detecting sensor 25*a*, the collected half-tablet detecting sensor 49*a*, and the stored half-tablet detecting sensor 50*a*, and the host computer 51, and drivingly controls the shutters 17, 19*a*, 46, 49*b*, and 50*b*, the tablet supply section 1, the tablet cutting section 2, the tablet accumulating section 3, and the tablet packing section 4.

Next, operation of the tablet packing apparatus of above described construction will be described with reference to flow charts shown in FIGS. 10 through 19.

First, upon input of prescription data from the host computer 51 (step S1), decision is made as to whether or not the prescription data contains half-tablet indication data (indicating a tablet being cut and packed in the form of separate half tablets) (step S2). If any half-tablet indication data is not contained therein, the intermediate shutter 17 is switched to the tablet passage 18*b* side, whereby the tablet from tablet feeder 8 is supplied to the tablet packing section 4 as it is, for ordinary packing process (step S3).

Whilst, if the half-tablet indication data is included, the intermediate shutter 17 is pivoted to the tablet passage 18*a* side to cause the tablet discharge path 9 to communicate with the guide hopper 19 of the tablet cutting section 2 (step S4). Then, the quantity n of half tablets to be prescribed is calculated (step S5). Then, on the basis of the calculation, decision is made as to whether or not any surplus of half-tablet will occur (step S6), and a "surplus" flag (F1=1) or a "no surplus" flag (F1=0) is set (steps S7, S8) . For example, if the prescription data contains instruction "dosage for 7 days, 1 half-tablet for each dose, 3 times a day", necessary quantity of half-tablets is 21 tablets, that is, an odd number, then a "surplus" flag is set accordingly.

Then, decision is made as to whether or not corresponding half tablets are stored in the half-tablet storing assembly 48 (step S9), and a "stored" flag (F2=1) or a "not stored" flag (F2=0) is set (steps S10, S11).

Then, decision is made as to which flag is ON (steps S12, S13, S14). In case that the "surplus" flag and the "stored" flag are ON, the number N of tablets to be supplied from the tablet supply section 1 is set to (n−1)/2 (step S15). In case that the "surplus" flag is ON, but the "stored" flag is not ON, the number N of such tablets is set to (n+1)/2 (step S16). In case that the "surplus" flag is not ON, but the "stored" flag is On, the number N of such tablets is set to n/2 (step S17). Where neither of the flags is ON, the number N of such tablets is set to n/2 (step S18). Then, cutting and collecting process is carried out according to the so set number of tablets (step S19 to step S22).

In the cutting and collecting process, according to each respective preset number of tablets, the tablet alignment plate 14 of the tablet feeder 8 at which corresponding tablets are housed is rotated so that tablets are supplied, one by one, from the tablet supply section 1 to the tablet cutting section 2 (step S23) at which cutting process (step S24) to be described hereinafter is carried out. This process is repeated until tablets of such a number as determined in above described manner are totally cut and collected (step S25).

When all half tablets resulting from the cutting process as above described have been collected in the half-tablet collecting assembly 47, the following steps are carried out.

Figure 13:
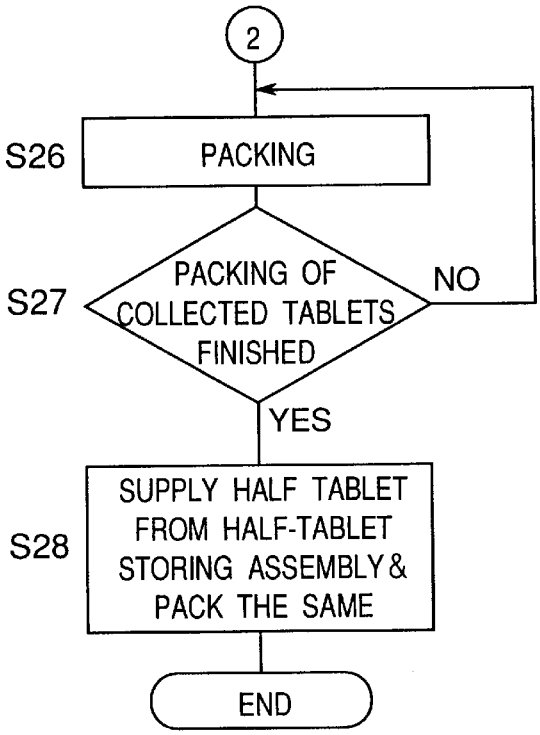
FIG. 13 is a flow chart showing the process of packing control continued from FIG. 11.

In case that two flags are ON (F1=1, F2=1) , that is, in case that there is a surplus of one half-tablet and one half-tablet is stored in the half-tablet storing assembly 48, the number of collected half tablet in the half-tablet collecting assembly 47 will be one half-tablet short. Therefore, as FIG. 13 shows, half tablets are sequentially supplied from the half-tablet collecting assembly 47 for packing (step S26), and when all of the half tablets have been packed (step S27), one corresponding half tablet is supplied from the half-tablet storing assembly 48 to the tablet packing section 4 for packing (step S28).

Figure 14:
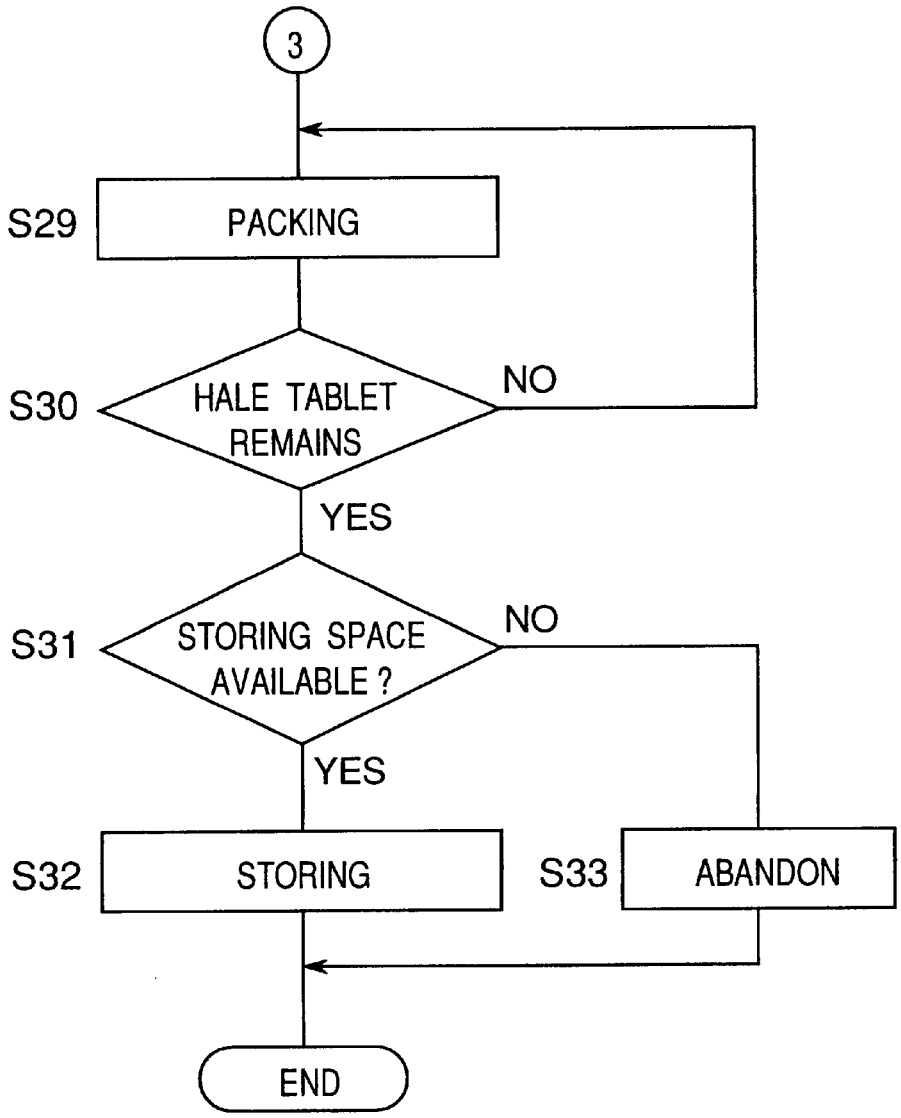
FIG. 14 is a flow chart showing the process of packing control continued from FIG 11.

In case that only the "surplus" flag is ON (F1=1, F2=0), that is, in case that there is a surplus of one half-tablet but no corresponding half-tablet is stored in the half-tablet storing assembly 48, the number of collected half tablets in the half-tablet collecting assembly 47 will be one half-tablet surplus. Therefore, as FIG. 14 shows, half tablets are sequentially supplied from the half-tablet collecting assembly 47 and packed (step S26), and when a last half tablet remains as it is (step S30), decision is made as to whether or not storing space is available in the half-tablet storing assembly 48 (step S31). If available, the half tablet is stored in the tablet storage chamber 50 of the half-tablet storing assembly 48 (step S32), and if not available, the half tablet is abandoned (step S33).

Figure 15:
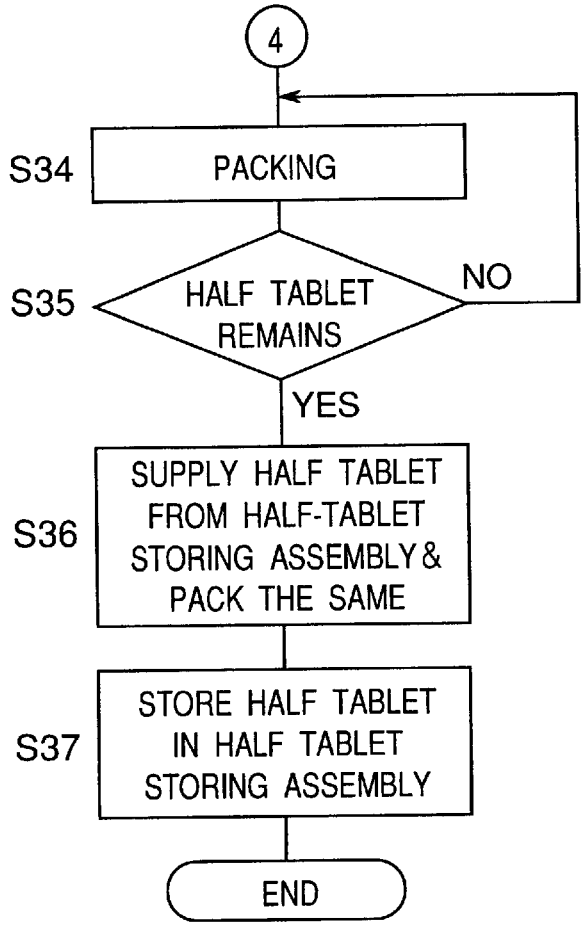
FIG. 15 is a flow chart showing the process of packing control continued from FIG 11.

In case that only the "stored" flag is ON (F1=0, F2=1), that is, in case that the number of half tablets collected in the half-tablet collecting assembly 47 coincides with the number of packs and one half-tablet is stored in the half-tablet storing assembly 48, packing is possible only with the one half-tablet collected in the half-tablet collecting assembly 47. If such packing is made, the old half tablet stored in the half-tablet storing assembly 48 remains as it is. Therefore, as FIG. 15 shows, half tablets are sequentially supplied from the half-tablet collecting assembly 47 and packed (step S34), and at the point of time when a last half tablet remains as it is (step S35), the one half-tablet stored in the half-tablet storing assembly 48 is packed (step S36), and the last remaining half-tablet at the half-tablet collecting assembly 47 is stored in the tablet storing chamber 50 of the half-tablet storing assembly 48 and stored therein (step S37).

Figure 16:
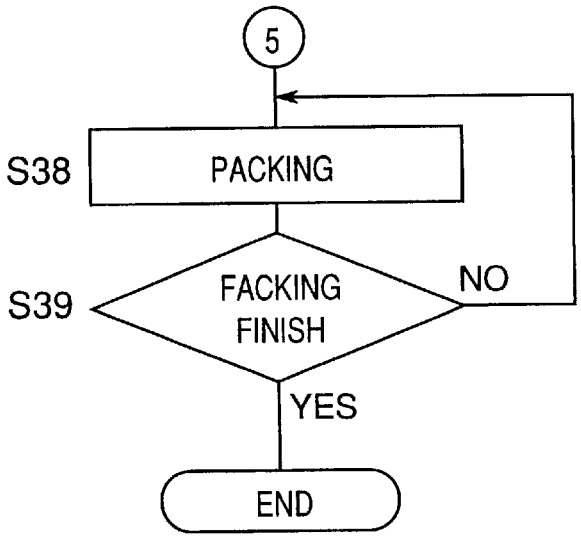
FIG. 16 is a flow chart showing the process of packing control continued from FIG. 11.

In case that neither of the flags is ON (F1=0, F2=0, that is, in case that the number of half tablets collected in the half-tablet collecting assembly 47 coincides with the number of packs and that any corresponding half tablet is not stored in the half tablet storing assembly 48, packing is possible only with half-tablets collected in the half-tablet collecting assembly 47. Accordingly, as FIG. 16 shows, all the half tablets stocked in the half-tablet collecting assembly 47 are packed (steps S38, 39).

It is noted in the above connection that packing is not limited to packing of a half tablet only for one dose, but packing may be made with respect to 1.5 tablets or a combination of the tablet and other kind of tablet. In that case, the intermediate shutter 17 should be switched according to the kind of tablets supplied from the tablet supply section 1.

Figure 17:
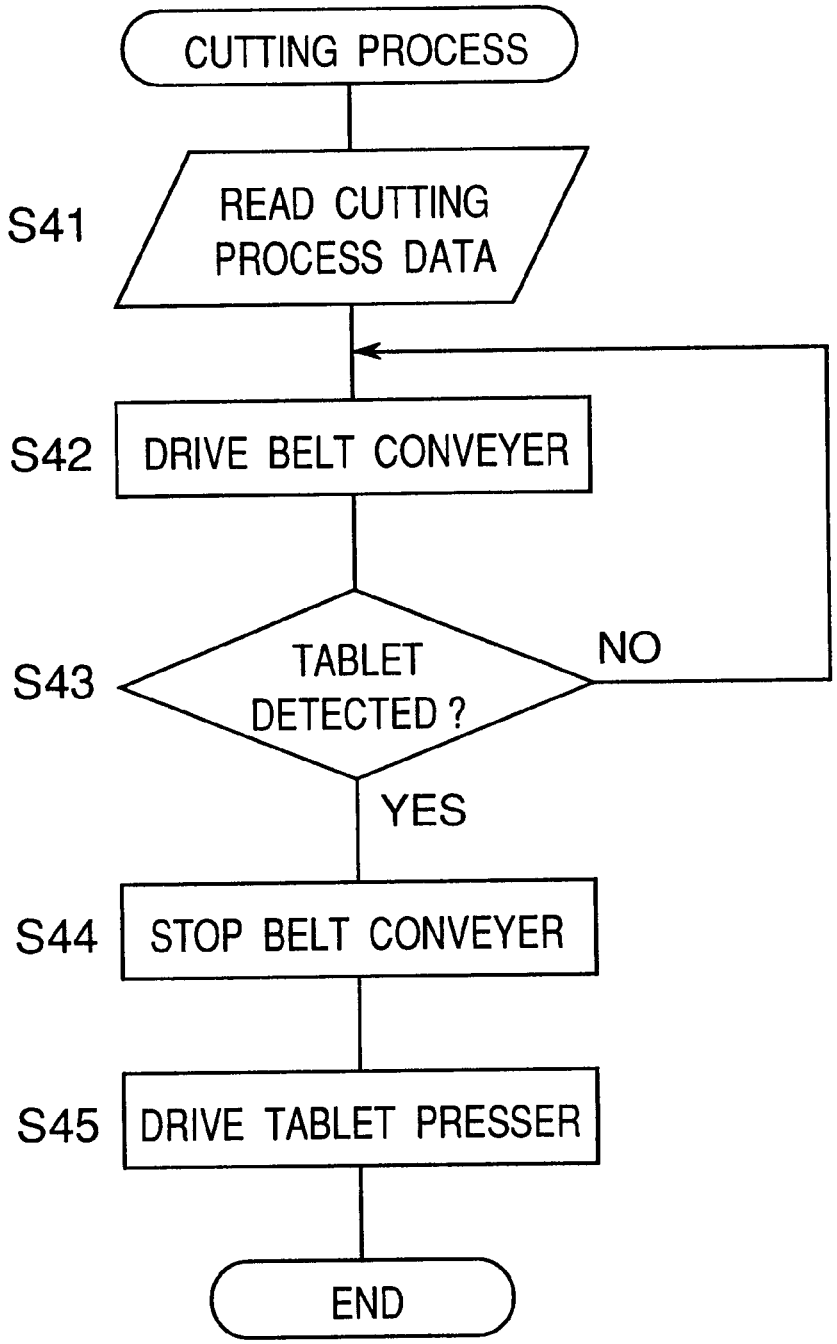
FIG. 17 is a flow chart showing the process of cutting in FIG. 12.
Figure 18:
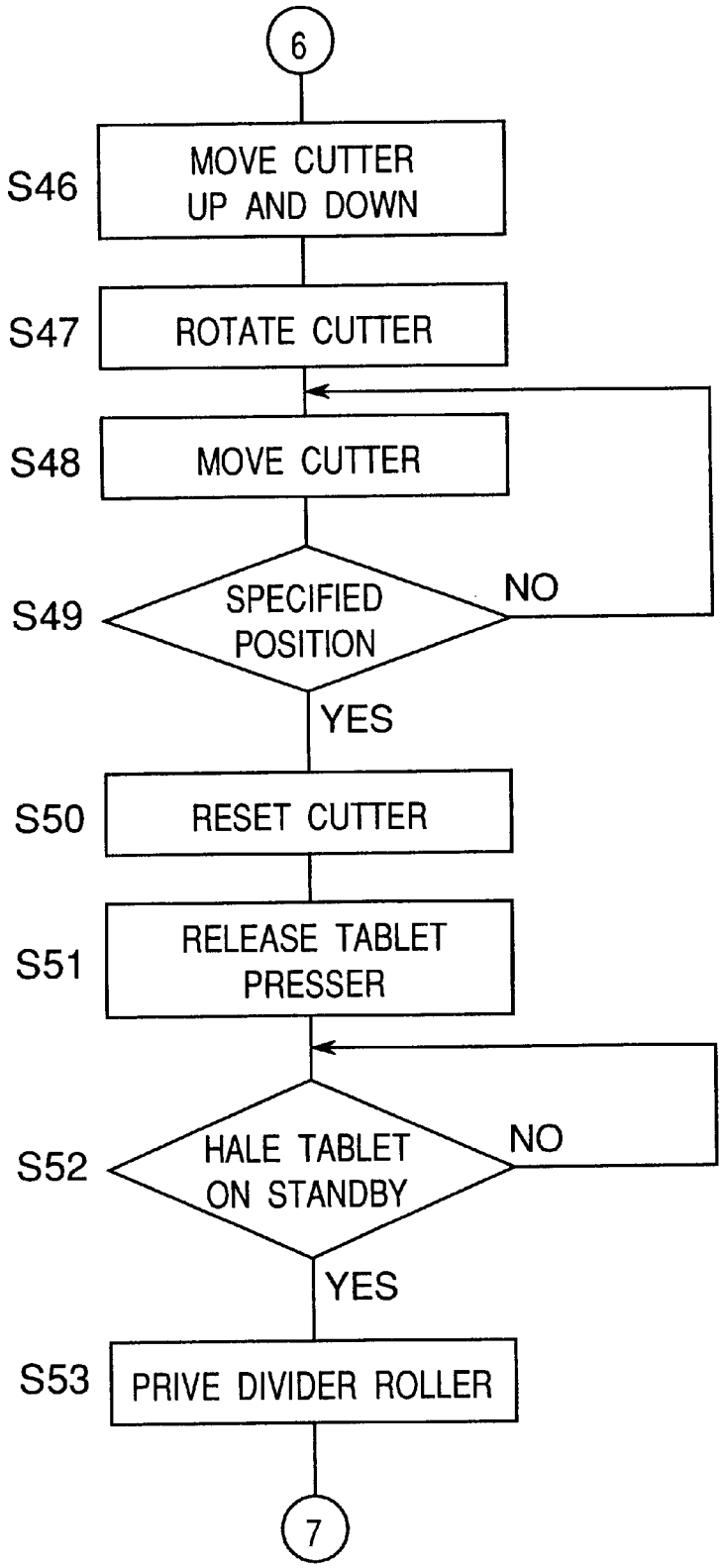
FIG. 18 is a flow chart showing the process of cutting continued from FIG. 17.
Figure 19:
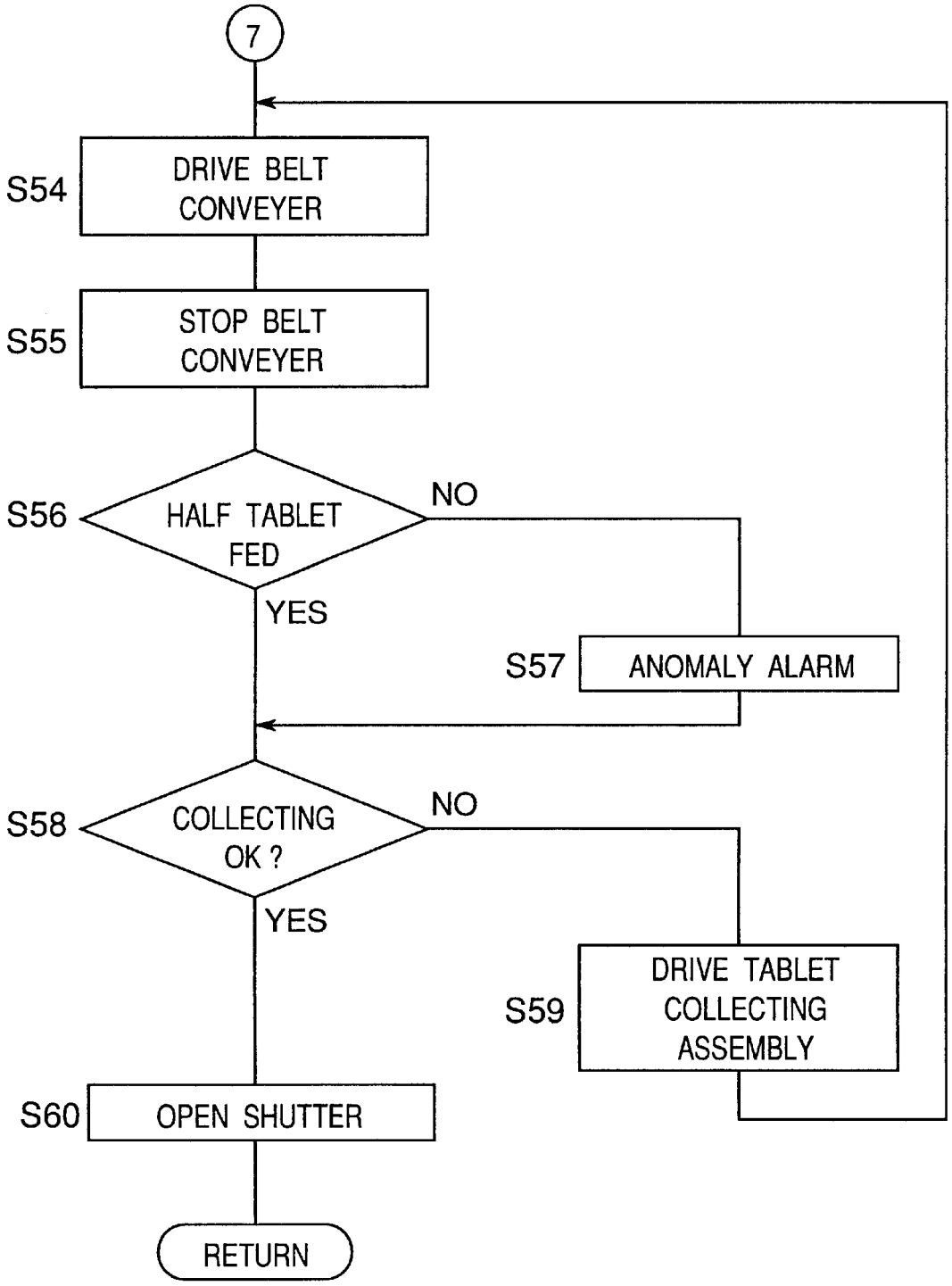
FIG. 19 is a flow chart showing the process of cutting continued from FIG. 17.

Next, the cutting process will be explained. As FIG. 17 shows, in the cutting process, cutting process data is first read (step S41). The cutting process data includes kind, quantity, and designation of the tablet supplied from the tablet supply section 1, and cutting conditions. The cutting conditions are programmed according to the kind of tablet as shown in the following table.

TABLE 1

| Kind of Medicine | Shape | Size t | Size D1 | Size D2 | Hardness | Depth of Cut | Feed Velocity | Feed Range | Rotational Speed |
|---|---|---|---|---|---|---|---|---|---|
| Tablet A | A | 2.7 | 7.2 | | 2 | 1.2 | 2 | 8.7 | 12000 |
| Tablet B | B | 4.8 | 8.4 | | 5 | 1.8 | 5 | 9.9 | 10000 |
| Tablet C | C | 4.1 | 9.3 | | 1 | 2.0 | 1 | 10.8 | 15000 |
| Tablet D | B | 4.2 | 9.6 | | 3 | 2.1 | 3 | 11.1 | 12000 |
| Tablet E | B | 3.6 | 8.2 | | 2 | 1.8 | 2 | 9.7 | 12000 |

TABLE 1-continued

| Kind of Medicine | Shape | Size t | Size D1 | Size D2 | Hardness | Depth of Cut | Feed Velocity | Feed Range | Rotational Speed |
|---|---|---|---|---|---|---|---|---|---|
| Tablet F | D | 4.5 | 8.6 | 5.3 | 3 | 2.2 | 3 | 10.1 | 12000 |
| . | . | . | . | . | . | . | . | . | . |
| . | . | . | . | . | . | . | . | . | . |

For example, in case that the thickness of the tablet is large, a depth of cut is large enough to enable easy division of the tablet without involving any subsequent trouble of crushing. In case that the hardness of the tablet is high, the feed velocity is increased. Thus, the cutting conditions are programmed to enable positive and accurate tablet division by subsequent divider roller 23 operation and enable cutting operation to be finished within earliest time period.

After reading the cutting process, the belt conveyer 20 is driven to start (step S42). Then, tablet movement is prevented by the plunger 28*c* of the tablet presser portion 26. If the tablet is detected by the tablet position detecting sensor 27*a* (step S43), movement of the belt conveyer 20 is stopped (step S44). Then, motor 32 is driven to pivotally move the cam 33 and move the presser pieces 28 of the tablet presser portions 26 in opposed directions (step S45). The respective rack gears 29*a* of the drive pieces 29 of the tablet presser portions are in mesh engagement with the gear 30 and the tablet presser portions 26 are connected by the springs 34 to each other. Therefore, the inclined surfaces 28*a* of the presser pieces 28 can always be moved to a predetermined central position. Thus, a tablet can be accurately centrally positioned. Furthermore, in the so positioned condition, the tablet is pressed by the inclined surfaces 28*a* against the belt conveyer 20, that is, the cutter table 27 and, therefore, will not go out of position.

Next, the milling cutter 22 is moved up and down so as to obtain a specified depth of cut according to the cutting conditions corresponding to the kind of tablet (step S46). Then, the motor 37 is driven to rotate the milling cutter 22 (step S47) for movement at a specified feed velocity (step 48). At this point of time, the plunger 28*c* of the tablet presser portion 26 is retreated from the inclined surfaces 28*a*. Thereafter, when the milling cutter 22 is moved within a specified feed range (step S49), rotation of the cutter is stopped and the cutter is caused to return to its initial position (step S50). Then, the condition of retention by the tablet presser portion 26 is released (step S51).

When the tablet is formed with a cut in this way, decision is made by the stored half-tablet detecting sensor 25*a* as to whether or not cut tablet (half tablet) is on standby in the storage container hopper 25 (step S52). If not on standby, the divider roller 23 is moved to a specified position corresponding to the thickness of the tablet (step S53), belt the conveyer 20 is driven again (step S54) to transport the tablet toward the downstream side. Accordingly, the so transported tablet is held between the divider roller 23 and the split receiver plate 39 (via the belt conveyor 20) to divide into halves. Then, the halves are guided to the storage container hopper 25 by the split guide plate 40. Then, operation of the belt conveyer 20 is once stopped (step S55) for checking through the stored half-tablet detecting sensor 25*a* whether or not a half tablet has been fed into the storage container hopper 25 (step S56). If already fed, operation proceeds to next step, and if not, an anomaly alarm is given, for example, by a buzzer, lamp, or the like (step S57).

Then, decision is made as to whether or not half-tablets in the storage container hopper 25 can be collected in tablet collecting assembly 47 (step S58). If a half tablet is already stored in the tablet collecting chamber 49 positioned below the storage container hopper 25, the tablet collecting assembly 47 is driven (step S59) so that a tablet collecting chamber 49 in which space is available is suitably positioned accordingly. Thus, when a space for receiving tablets is made available, the shutters 46 of the two storage container hoppers 25 are opened to allow the half tablets in the hoppers 25 to drop into the tablet collecting chamber 49 of the half-tablet collecting assembly 47 (step S60).

In the foregoing embodiment, a drawer type arrangement is used for the tablet supply section 1. However, arrangement of other type, such as drum type, may be employed. In effect, any arrangement which can house tablets kind by kind and supply the tablets in a prescribed quantity at a time is acceptable for the purpose of the present invention.

Figure 20:
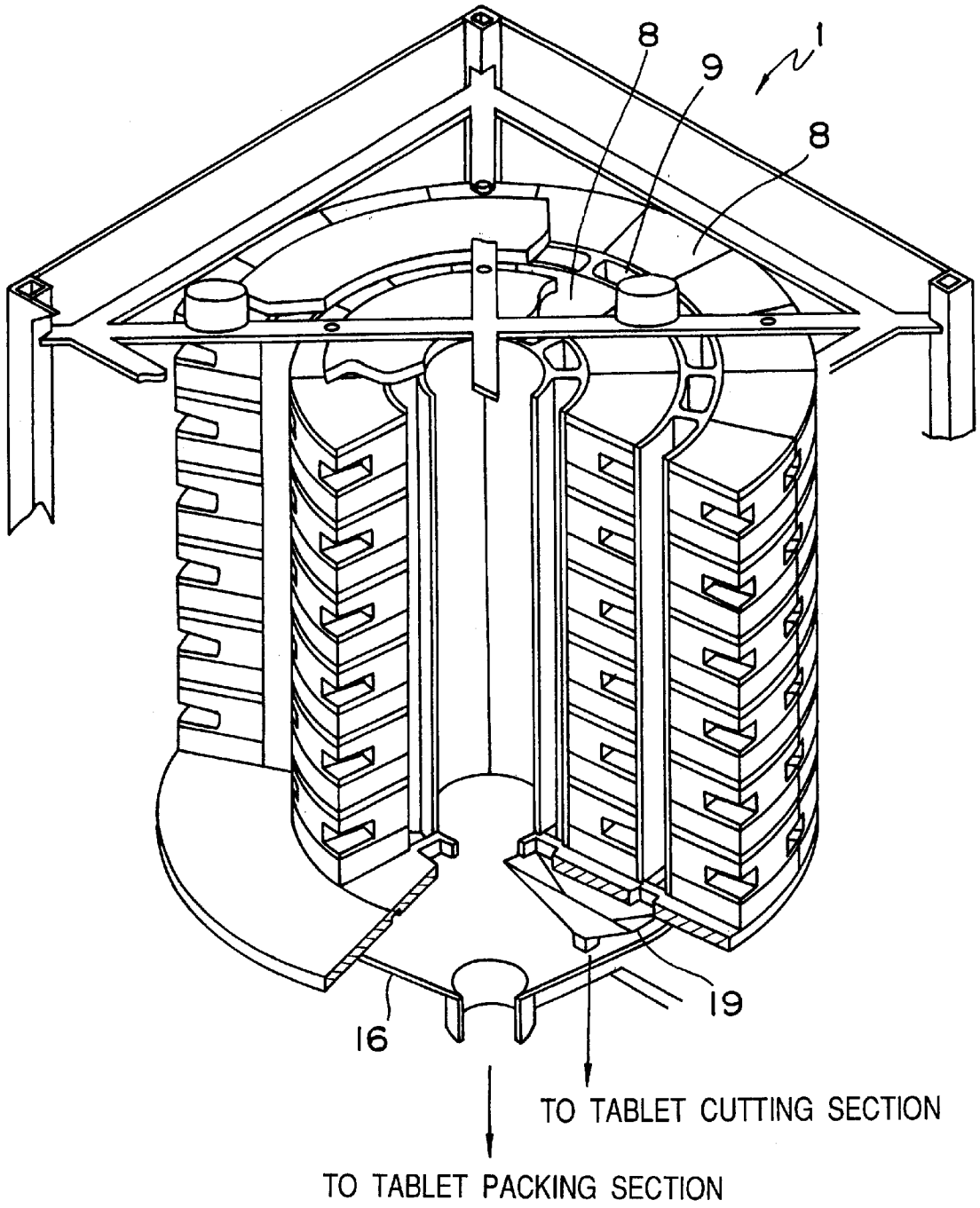
FIG. 20 is a perspective view showing a variation of the tablet supply section.

Shown in FIG. 20 by way of example is a case in which a drum type arrangement is employed as a tablet supply section 1. The tablet supply section 1 of this type has tablet feeders 8 arranged in a doughnut pattern which are rotatable in circumferential direction. Between inner periphery side tablet feeders 8 and outer periphery side feeders 8 there are formed tablet discharge paths 9.

In such a drum type arrangement, where one tablet is supplied to a tablet packing section 4 as it is, the tablet is collected by hopper 16 disposed below the tablet supply section 1. Whilst, where a tablet is cut into halves, half tablets are collected by a guide hopper 19 provided above the hopper 16 separately from the hopper 16 for supply to a tablet cutting section 2. Therefore, supply of one tablet as it is and supply of one tablet in the form of halves can be separately (simultaneously) carried out, and this provides for good working efficiency.

Figure 21:
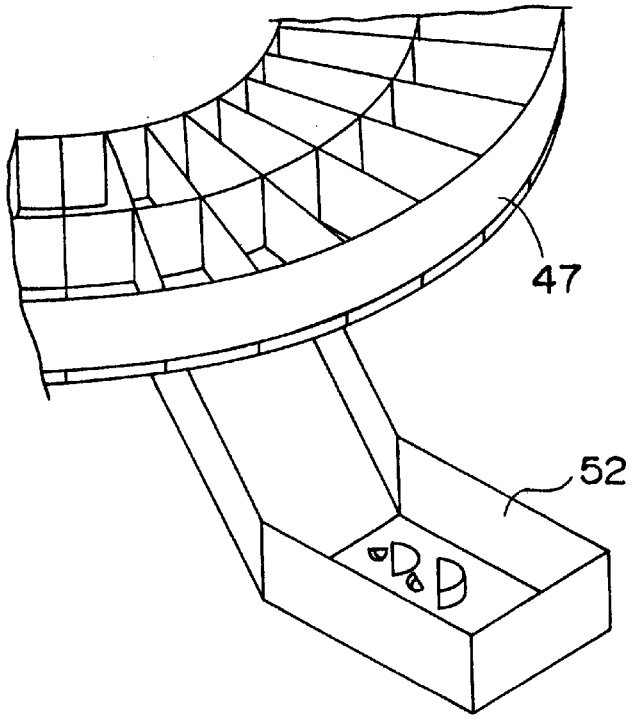
FIG. 21 is a fragmentary view in perspective showing a variation of the tablet collecting assembly.

In the foregoing embodiment, surplus half tablets are stored in half-tablet store assembly 48. However, as FIG. 21 shows, where any surplus is abandoned for deposit in an abandonment box 52, the half-tablet store assembly 48 is unnecessary.

Figure 22:
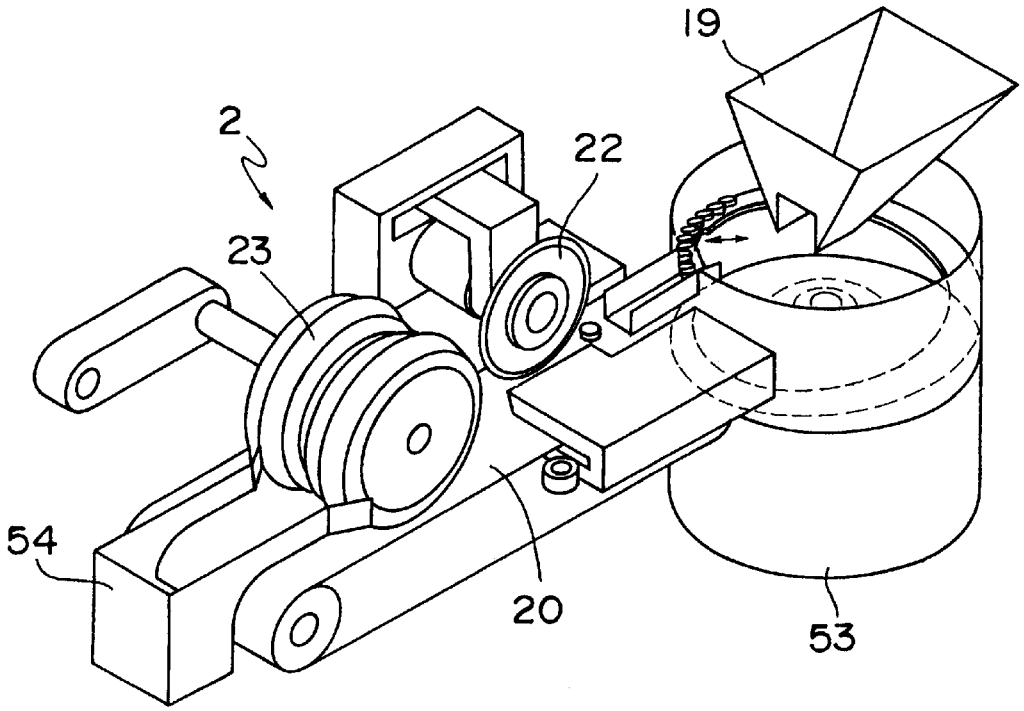
FIG. 22 is a perspective view showing a variation of the tablet cutting section.

In the foregoing embodiment, tablets are supplied one by one from the tablet housing section 1 to the tablet cutting section 2. However, a parts feeder 53 as shown in FIG. 22 may be provided. Such parts feeder 53 makes it possible to initially supply a predetermined number of tablets from the tablet housing section 1 to the parts feeder 53 and thereafter supply tablets one by one. In FIG. 22, half-tablets resulting from cutting by the milling cutter 22 and divider roller 23 are collected into a collecting box 54 provided at one location.

In the foregoing embodiment, description is made with respect to an apparatus for packing tablets for one dose into one pack. However, tablets may be housed (packed) in a vial.

In the foregoing embodiment, the half-tablet collecting assembly 47 and the half-tablet storing assembly 48 of the tablet accumulating section 3 are of disc shape, but other configuration or form, for example, recesses for housing tablets formed in parallel on a linear line may be acceptable.

In the foregoing embodiment, the half-tablet collecting assembly is provided, but it is not necessarily required. In that case, half-tablets produced by cutting at the tablet cutting section 2 may be supplied from the storage container hopper 25 directly to the tablet packing section 4.

Half-tablets may be always stored in the half-tablet store assembly 48 irrespective of the number of half-tablet packs.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A tablet packing apparatus comprising:

a tablet supply section for supplying tablets stored kind by kind;

a tablet cutting section for cutting each tablet supplied from the tablet supply section into two parts;

a tablet accumulating section for accumulating tablets cut by the tablet cutting section; and a tablet packing section for packing tablets stocked in the tablet accumulating section.

2. A tablet packing apparatus as in claim 1, wherein the tablet supply section includes a passage changeover means for changing over between a passage for supplying tablets to the tablet cutting section and a passage for supplying tablets directly to the tablet packing section.

3. A tablet packing apparatus as in claim 1, wherein the tablet cutting section comprises:

a transport portion for transporting tablets supplied from the tablet supply section; and a tablet positioning portion for positioning tablets transported by the transport portion at predetermined positions.

4. A tablet packing apparatus as in claim 3, wherein the tablet positioning portion has inclined surfaces adapted to abut the tablet from opposite sides in rectangular relation to the direction of tablet transport in such a way as to press the tablet downward.

5. A tablet packing apparatus as in claim 3, wherein the tablet cutting section includes:

a cutter for notching a tablet; and a divider roller for dividing the tablet into two halves along the notch formed by the cutter.

6. A tablet packing apparatus as in claim 1, wherein the tablet accumulating section includes a half-tablet collecting assembly for collecting half tablets obtained at the tablet cutting section and supplying the half tablets, one by one, to the tablet packing section.

7. A tablet packing apparatus as in claim 6, further comprising a half-tablet storing assembly for temporarily storing any surplus half-tablets remaining in the half-tablet collecting assembly.

8. A tablet packing apparatus as in claim 7, further comprising control means which, according to a difference in the number of packs at the tablet packing section, cause a corresponding half tablet to be supplied from the half-tablet storing assembly.

9. A tablet packing apparatus as in claim 8, wherein in the case that the number of packs of half tablets is an odd number, if a half tablet of the corresponding kind is stored in the tablet storing assembly, the tablets to be supplied from the tablet supply section to the tablet cutting section is reduced by one in number.

10. A tablet packing apparatus as in claim 8, wherein in the case that the number of packs of half tablets is an even number, if a half tablet of the corresponding kind is stored in storage in the tablet storing assembly, one of the halves resulting from cutting at the tablet cutting section is caused to replace the corresponding half tablet held in storage at the tablet storing assembly.

11. A tablet packing apparatus as in claim 1, further comprising:

memory means for storing cutting conditions corresponding to each respective kind of tablet; and control means operative to call the cutting conditions stored in the memory means according to the kind of tablet supplied and to drivingly control the tablet cutting section according to the cutting conditions.

* * * * *